US007236728B2

(12) United States Patent
Noda et al.

(10) Patent No.: US 7,236,728 B2
(45) Date of Patent: Jun. 26, 2007

(54) DEVELOPING DEVICE AND IMAGE FORMATION DEVICE

(75) Inventors: Akihiko Noda, Ebina (JP); Hirotaka Matsuoka, Minamiashigara (JP); Tsutomu Kubo, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 83 days.

(21) Appl. No.: 11/068,900

(22) Filed: Mar. 2, 2005

(65) Prior Publication Data

US 2006/0062605 A1 Mar. 23, 2006

(30) Foreign Application Priority Data

Sep. 21, 2004 (JP) ..... 2004-274154

(51) Int. Cl.
*G03G 15/09* (2006.01)

(52) U.S. Cl. ..... 399/277; 399/276

(58) Field of Classification Search ..... 399/277, 399/276

See application file for complete search history.

(56) References Cited

U.S. PATENT DOCUMENTS 3,939,801 A * 2/1976 Tanaka et al. ..... 399/277 X
4,030,447 A * 6/1977 Takahashi et al. ..... 399/277 X
4,425,373 A * 1/1984 Hosono et al. ..... 399/277 X
5,491,541 A * 2/1996 Yokoyama et al. ..... 399/277
5,860,049 A * 1/1999 Kumasaka et al. ..... 399/277 X
2002/0057930 A1* 5/2002 Okada et al. ..... 399/277 X

FOREIGN PATENT DOCUMENTS

JP A 62-38476 2/1987
JP 04066958 A * 3/1992
JP A 11-27484 1/1999
JP 2004038113 A * 2/2004

* cited by examiner

*Primary Examiner*—David M. Gray
*Assistant Examiner*—Erika J. Villaluna
(74) *Attorney, Agent, or Firm*—Oliff & Berridge PLC

(57) ABSTRACT

A developing device for developing an electrostatic latent image, which is formed on an image-bearing body, with a developer which includes a toner and a carrier, the developing device comprises a developing roll, which includes a fixed magnet at an interior portion and a rotatable sleeve at an outer side thereof, and which is disposed to oppose the image-bearing body, rotates while carrying the developer, and conveys the developer to a developing region in a direction opposite to a direction of progress of the image-bearing body for developing the electrostatic latent image formed on the image-bearing body, wherein the developing roll includes a magnetic pole which includes, in a circumferential direction of the developing roll, at least two magnetic flux density peaks with the same polarity in the developing region, one of the magnetic flux density peaks opposing an end portion of the developing region at a downstream side in the direction of progress of the image-bearing body.

15 Claims, 8 Drawing Sheets

DEVELOPING DEVICE AND IMAGE FORMATION DEVICE

CROSS-REFERENCE TO RELATED APPLICATION

This application claims priority under 35 USC 119 from Japanese Patent Application No. 2004-274154, the disclosure of which is incorporated by reference herein.

BACKGROUND OF THE INVENTION

1. Field of the Invention

The present invention relates to a developing device to be employed in an image formation device at which an electrophotography system is applied, such as a copier, a printer, a fax machine, a multifunction device including functions thereof and to an image formation device which employs this developing device.

2. Description of the Related Art

Conventionally, a developing device which is charged with a developing agent (a "two-component developer" formed of a toner and a magnetic carrier) is mounted at an image formation device at which an electrophotography system is applied, such as a copier, a printer, a fax machine, a multifunction device including functions thereof, or the like. This developing device (a developing roll) is disposed to oppose a photosensitive body, the toner is adhered to a surface of the photosensitive body, and an electrostatic latent image is made visible with the toner. Thus, image formation is implemented.

In order to improve movement of the magnetic carrier within a development nipping area and raise developing efficiency of such a two-component developer, lowering of carrier magnetizations has been implemented (see Japanese Patent Application Laid-Open (JP-A) No. 62-38476, JP-A No. 11-27484 and suchlike).

However, when magnetic flux density of a developing magnetic pole is lowered and/or carrier magnetization is lowered, there is a problem in that adherence of carrier to an image-bearing body is more likely to occur, particularly in conditions of high temperature and high humidity, low temperature and low humidity, and the like.

In particular, because a toner with small particle diameters has a larger overall toner surface area, in order to use such a toner, it is desirable to reduce particle diameters of the carrier and increase surface area of the carrier. However, in such a case, magnetic attraction of the carrier is lowered, and therefore, adherence of the carrier to an image-bearing body is more likely to occur.

Adherence of carrier to an image-bearing body is likely to occur when a contrast between respective potentials at an image portion and a non-image portion is large. When carrier adherence occurs at an image portion, because the carrier particles are larger than the toner particles, a toner image and a transfer object body cannot be tightly contacted in the vicinity of an adhered carrier particle, and transfer dropouts will occur at and around these carrier particles.

Furthermore, if carrier adherence occurs at either of a non-image portion and an image portion, carrier particles that are not transferred can cause damage to a cleaner, the photosensitive body and the like, while carrier particles that are transferred are developed in the form of stains in an image, and can cause damage to a fixing device.

SUMMARY OF THE INVENTION

Accordingly, in order to solve various problems of conventional technology, the present invention will provide a developing device which raises a developing efficiency of two-component development without causing adherence of carrier to an image-bearing body, even when there are variations in environment, and an image formation device which is equipped with this developing device.

This object is achieved by the following aspects. Specifically, in a first aspect of the present invention, a developing device develops an electrostatic latent image, which is formed on an image-bearing body, with a developer which includes a toner and a carrier. The developing device includes a developing roll, which includes a fixed magnet at an interior portion and a rotatable sleeve at an outer side thereof, and which is disposed to oppose the image-bearing body, rotates while carrying the developer, and conveys the developer to a developing region in a direction opposite to a direction of progress of the image-bearing body for developing the electrostatic latent image formed on the image-bearing body, The developing roll includes a magnetic pole which includes, in a circumferential direction of the developing roll, at least two magnetic flux density peaks with the same polarity in the developing region (herebelow, this developing magnetic pole may be referred to as a repelling pole), and one of the magnetic flux density peaks opposes an end portion of the developing region at a downstream side in the direction of progress of the image-bearing body.

In the present aspect, the magnetic pole is provided at the developing roll so as to feature at least two peaks in magnetic flux density in the developing region, with the same polarization, in the circumferential direction of the developing roll. Of these two or more magnetic flux density peaks, at least, for example, one peak at the downstream side opposes the end portion of the developing region at the downstream side in the direction of progress of the image-bearing body. Hence, the developer is conveyed to the developing region by the developing roll in the direction opposite to the direction of progress of the image-bearing body, and the electrostatic latent image that has been formed on the image-bearing body is developed.

At this time, the developer that is carried on the developing roll is first exposed to the magnetic flux density peak which opposes an end portion of the developing region on the downstream side of progress direction of the image-bearing body, and is then sequentially exposed to the other magnetic flux density peak(s).

Generally, developer over magnetic poles is formed up into spikes, which become crushed when they oppose an image-bearing body. Consequently, density of the developer is higher and the developer is less free to move in such regions. However, at the developing device of the present invention, a region between two peaks of the repelling pole (a repelling region) is made to oppose the image-bearing body. As this a region makes the spikes of the developer looser (when not opposing an image-bearing body), when this region opposes the image-bearing body, the spikes have been brought into a state in which they are loosened as compared with the previous state thereof. As a result, the toner is more likely to adhere to the image-bearing body from carrier surfaces.

Because magnetic forces in this region are weak, occurrences of carrier adherence to the image-bearing body are more likely. When carrier does adhere to the image-bearing body, the carrier is carried on the image-bearing body and conveyed downstream to a fairly strong magnetic pole, where the carrier is recovered to the developing roll by the scraping effect brought by the strong magnetic pole and a dense spike.

Generally, in a developing system in which an image-bearing body surface and a two-component development roller surface move in opposite directions to one another, tracks in the form of scraping of a development image on the image-bearing body, known as "brush marks", are likely to occur. However, with the developing device of the present invention, such occurrences will not be noticeable.

This is because, although there is a lot of carrier exposed at the surface from which toner has been removed, scraping force is weak at the repelling region, so brush marks will not occur. At the downstream pole, because most of the carrier has not had the toner removed therefrom, scraping force is strong. However, in practice, there is little exposure of carrier surfaces which will attract toner so as to scrape off the toner, whereby it is expected that there will be effects such that carrier adherence is unlikely to occur and there is very little scraping of toner.

Consequently, the developing efficiency of two-component development can be raised without causing occurrences of carrier adherence to the image-bearing body, even when there are variations in environment.

In a second aspect of the present invention, of the at least two magnetic flux density peaks included at the magnetic pole, the magnetic flux density peak that is disposed at an end portion of the developing region on the downstream side of progress direction of the image-bearing body includes a magnetic flux density greater than a magnetic flux density peak that is disposed further to the upstream side.

According to the present aspect, when the developer that is carried on the developing roll is exposed to the magnetic flux density peak that opposes the end portion of the developing region on the downstream side of progress direction of the image-bearing body, an effect of recovery of carrier is increased. However, an effect of scraping of the toner image does not become correspondingly stronger.

As a result, the developing efficiency of the two-component development can be more effectively improved without causing occurrences of carrier adherence to the image-bearing body.

In a third aspect of the present invention, an alternating electric field is applied to the developing region.

As a result, the developing efficiency of the two-component development can be more effectively improved.

In a fourth aspect of the present invention, a magnetization of the carrier is at most 50 emu/cm$^3$.

As a result, the developing efficiency of the two-component development can be more effectively improved without causing carrier adherence to the image-bearing body.

In a fifth aspect of the present invention, a volume average particle diameter of the toner is at least 1.5 μm and at most 5 μm. Furthermore, a volume average particle diameter of the carrier is at most 8 times the volume average particle diameter of the toner.

As a result, particularly in a case in which a toner with small particle diameters and a carrier with small particle diameters, which tend to reduce carrier adherence and developing efficiency, are employed, the developing efficiency of the two-component development can be improved without causing carrier adherence to the image-bearing body.

In a sixth aspect of the present invention, an image formation device includes: a developing section which develops an electrostatic latent image, which is formed on an image-bearing body, with developer; and a transfer section which transfers a toner image that has been developed on the image-bearing body to a recording medium for forming an image. A developing device of the present invention as described above is employed as the developing section.

According to the present aspect, because a developing device based on the first to fifth aspects described above is employed, the developing efficiency of two-component development can be raised without causing occurrences of carrier adherence to the image-bearing body, even when there are variations in environment. Consequently, images with excellent image quality can be provided and damage to various members, such as the image-bearing body and the like, can be avoided.

To summarize, according to the present invention, it is possible to provide a developing device which raises a developing efficiency of two-component development without causing carrier adherence to an image-bearing body to occur, even when there are variations in environment, and an image formation device which is equipped with this developing device.

DETAILED DESCRIPTION OF THE INVENTION

Figure 1:
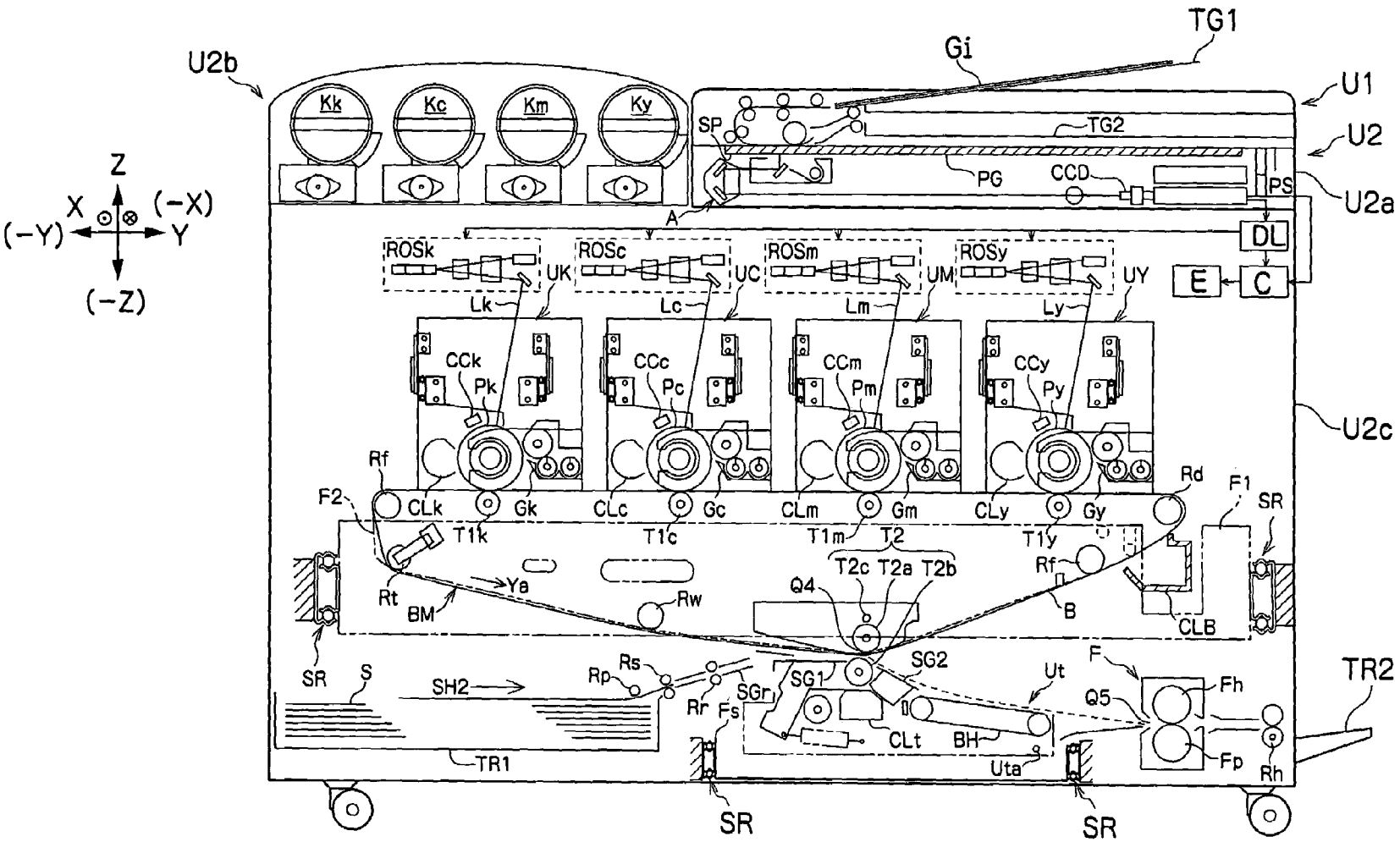
FIG. 1 is a schematic structural view showing an image formation device relating to an embodiment of the present invention.

Herebelow, the present invention will be described in detail with reference to the drawings. Note that descriptions are given with members that have substantially the same functions being given the same reference characters throughout the drawings, and descriptions thereof being omitted where appropriate.

Figure 2:
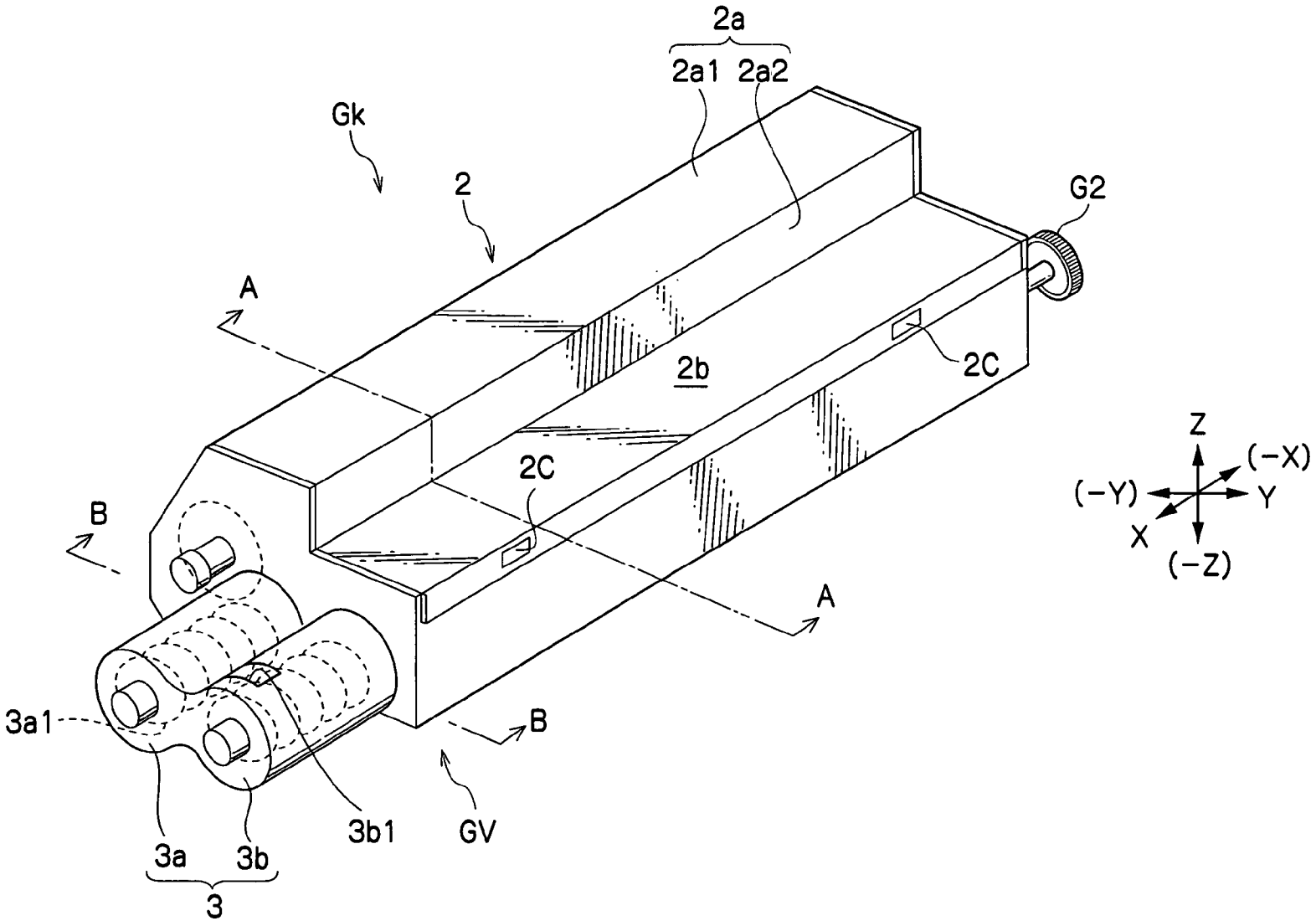
FIG. 2 is a perspective view showing a developing device relating to the embodiment of the present invention.
Figure 3:
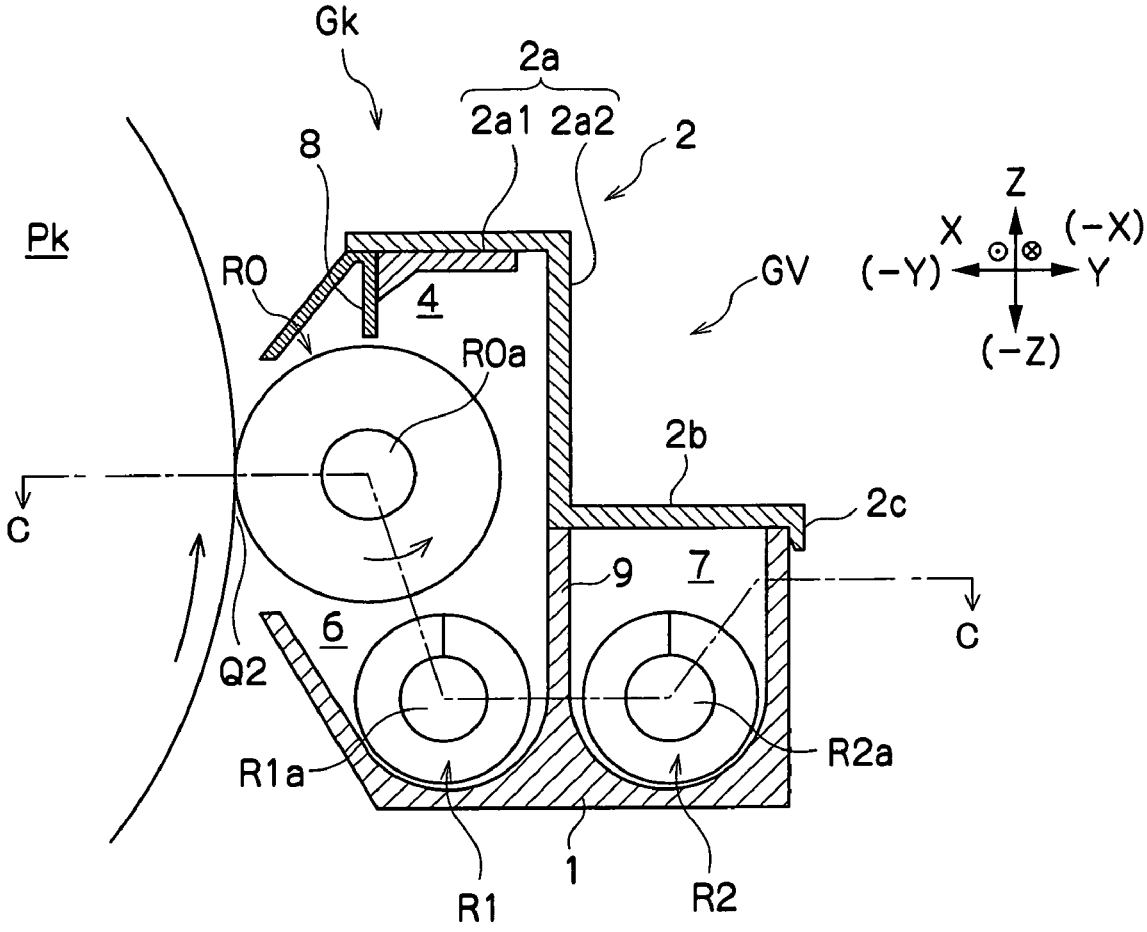
FIG. 3 is a side sectional view showing the developing device relating to the embodiment of the present invention, being a sectional view cut along line A—A of FIG. 2.
Figure 4:
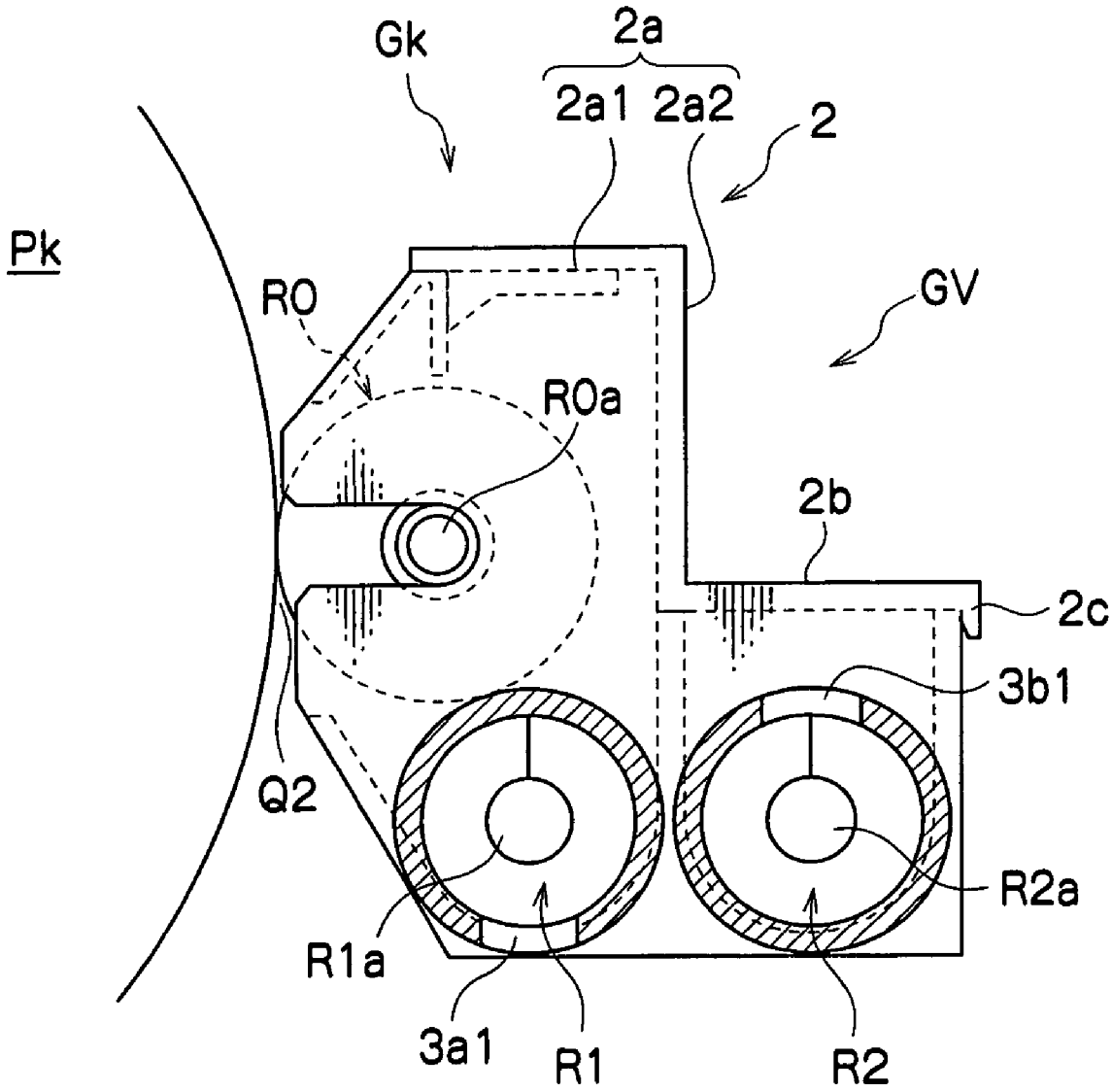
FIG. 4 is a side sectional view showing the developing device relating to the embodiment of the present invention, being a sectional view cut along line B—B of FIG. 2.
Figure 5:
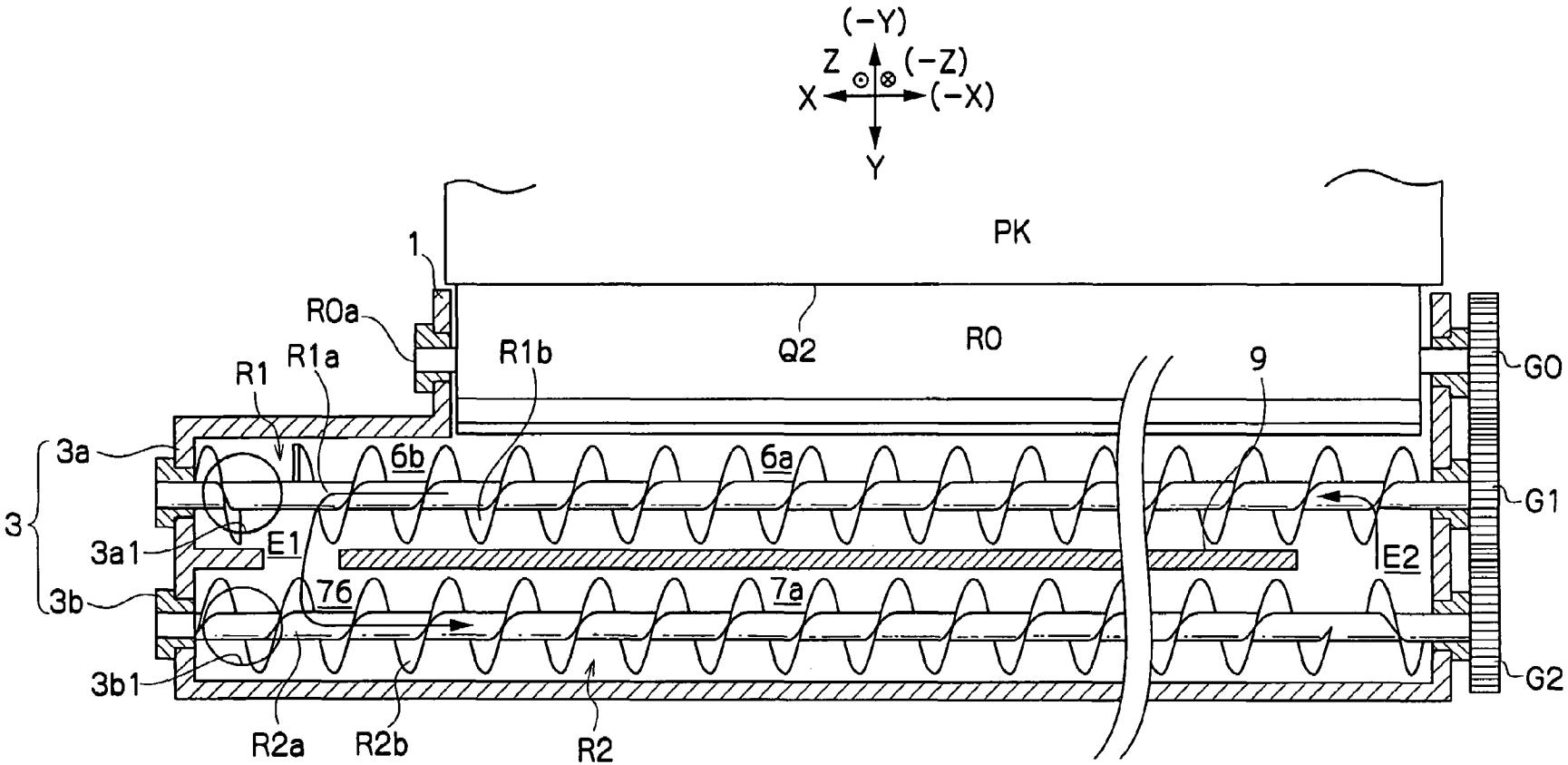
FIG. 5 is a plan sectional view showing the developing device relating to the embodiment of the present invention, being a sectional view cut along line C—C of FIG. 3.

FIG. 1 is a schematic structural view showing an image formation device relating to an embodiment of the present invention. FIG. 2 is a perspective view showing a developing device relating to the embodiment of the present invention. FIG. 3 is a side sectional view showing the developing device relating to the embodiment of the present invention, being a sectional view cut along line A—A of FIG. 2. FIG. 4 is a side sectional view showing the developing device relating to the embodiment of the present invention, being a sectional view cut along line B—B of FIG. 2. FIG. 5 is a plan sectional view showing the developing device relating to the embodiment of the present invention, being a sectional view cut along line C—C of FIG. 3.

In order to facilitate understanding of the descriptions below, a front-rear direction in the drawings is an X-axis direction, a left-right direction is a Y-axis direction and an up-down direction is a Z-axis direction. Directions and sides shown by arrows X, −X, Y, −Y, Z and −Z are forward, rearward, leftward, rightward, upward and downward, respectively (in other words, a front side, a rear side, a left side, a right side, an upper side and a lower side, respectively). Further, in the drawings, a symbol shown as a dot inside a circle represents an arrow oriented from the rear to the front of the drawing paper, and a symbol shown as a diagonal cross within a circle represents an arrow oriented from the front to the rear of the drawing paper.

As shown in FIG. 1, an image formation device U relating to the present embodiment features an automatic original conveyance apparatus U1, and a copier U2 including a platen glass PG, which supports the automatic original conveyance apparatus U1.

The automatic original conveyance apparatus U1 includes an original supply tray TG1, at which a plurality of originals Gi, which are to be copied, are placed in a stack. In this structure, the plurality of originals Gi stacked on the original supply tray TG1 are sequentially passed through a copying position on the platen glass PG of the copier U2, and are ejected to an original ejection tray TG2.

The automatic original conveyance apparatus U1 can be rotated relative to the copier U2 about a hinge axis (not shown) provided at a rear end portion (the −X end portion) of the automatic original conveyance apparatus U1, which extends in the left-right direction. The automatic original conveyance apparatus U1 is rotated upward when originals Gi are to be manually placed on the platen glass PG by an operator.

The copier U2 includes a printer U2*c*, at an upper face of which an image scanner U2*a* and a toner supply apparatus U2*b* are supported.

The platen glass PG is provided at an upper face of the image scanner U2*a*, and the automatic original conveyance apparatus U1 is supported at an upper face of the platen glass PG. At the image scanner U2*a*, light is irradiated at an original Gi that is passing through the copying position on the platen glass PG by an exposure light source of an exposure optical system A. Irradiated light that is reflected from the original Gi passes through mirrors and the like of the exposure optical system A, and is converted to digital signals for R (red), G (green) and B (blue) by a CCD (a solid-state image capture device).

The RGB electronic signals are converted to image data of K (black), Y (yellow), M (magenta) and C (cyan) by an image processing system (IPS). Image processing such as density correction, magnification, reduction and the like is applied, after which the image data is inputted to the printer U2*c* with a predetermined timing.

A user interface (UI) is provided at the image scanner U2*a*. The UI is provided with an unillustrated copy start key, a 10-key pad, a display device and the like.

The toner supply apparatus U2*b* includes cartridge mounting portions at which toner cartridges Ky, Km, Kc and Kk are removably mounted. The toner cartridges Ky, Km, Kc and Kk accommodate toner of the colors Y (yellow), M (magenta), C (cyan) and K (black). Toner in the toner cartridges Ky, Km, Kc and Kk is supplied to developing devices Gy, Gm, Gc and Gk of the respective colors. Details of such a toner supply apparatus U2*b* are described in JP-A No. 8-171248, a patent application submitted by the present applicants.

A laser driving circuit DL of the printer U2*c* outputs laser driving signals to latent image formation devices (image-writing devices) ROSy, ROSm, ROSc and ROSk, of toner image formation devices UY, UM, UC and UK of the respective colors. The laser driving signals are based on the image data of K (black), Y (yellow), M (magenta) and C (cyan) inputted from the image scanner U2*a*.

The toner image formation device UK for K (black) includes a photosensitive drum (image-bearing body) Pk, which is driven to rotate. A surface of the rotating photosensitive drum Pk is statically charged by a charger CCk and is irradiated with a laser beam Lk, which is emitted from the latent image formation device ROSk (the latent image formation device for black), to form an electrostatic latent image. The electrostatic latent image is developed to a toner image by the developing device Gk, the toner image is primary-transferred to an intermediate transfer belt B by a primary-transfer roller T1*k*, and surplus toner after the transfer is cleaned off by a cleaner CLk.

Further, as around the photosensitive drum Pk, chargers CCy, CCm and CCc, the developing devices Gy, Gm and Gc, primary-transfer rollers T1*y*, T1*m* and T1*c*, cleaners CLy, CLm and CLc, and the like are disposed around photosensitive drums (image-bearing bodies) Py, Pm and Pc of the other toner image formation devices UY, UM and UC, respectively.

Accordingly, after the photosensitive drums Py, Pm, Pc and Pk have been uniformly charged by the chargers CCy, CCm, CCc and CCk, respectively, electrostatic latent images are formed at the surfaces of the photosensitive drums by laser beams Ly, Lm, Lc and Lk emitted from the latent image formation devices ROSy, ROSm, ROSc and ROSk. The electrostatic latent images at the surfaces of the photosensitive drums Py, Pm, Pc and Pk are developed to toner images of the colors Y (yellow), M (magenta), C (cyan) and K (black) by the developing devices Gy, Gm, Gc and Gk. The toner images on the surfaces of the photosensitive drums Py, Pm, Pc and Pk are sequentially superposedly transferred onto the intermediate transfer belt (transfer member) B by the primary-transfer rollers T1*y*, T1*m*, T1*c* and T1*k*, to form a color image on the intermediate transfer belt B. The color toner image that has been formed on the intermediate transfer belt B is fed to a secondary-transfer region Q4.

Note that in a case of black image data alone, only the toner image formation device UK for K (black), featuring the photosensitive drum Pk and the developing device Gk, is used and only a black toner image is formed.

Below the photosensitive drums Py, Pm, Pc and Pk of the respective colors, a sliding frame F1 is supported by a pair of left and right sliding rails SR and SR to be slidably movable forward and rearward (i.e., in a direction perpendicular to the paper of FIG. 1).

At the sliding frame F1, a belt frame F2 of a belt module BM is supported to be vertically movable between a raised operation position and a maintenance position, to which the belt frame F2 is moved downward from the operation position. A structure for moving the sliding frame F1 forward and rearward and a structure for raising and lowering the belt module BM are conventionally known structures (see, for example, JP-A No. 8-171248), and various other conventionally known structures can be employed.

The belt module BM includes the intermediate transfer belt B, belt support rollers and the primary-transfer rollers T1*y*, T1*m*, T1*c* and T1*k*. The belt support rollers include a belt driving roller Rd, a tensioning roller Rt, a walking roller Rw, a plurality of idling rollers (free rollers) Rf and a backup roller T2*a*. Thus, the intermediate transfer belt B is supported by the belt support rollers (Rd, Rt, Rw, Rf and T2*a*) to be movable for turning in the direction of an arrow Ya.

A secondary-transfer unit Ut is disposed downward of the backup roller T2*a*. The secondary-transfer unit Ut is supported by a sliding frame Fs to be rotatable about a hinge axis Uta, between a raised position which is swung upward and a lowered position which is swung downward.

A secondary-transfer roller T2*b* of the secondary-transfer unit Ut is disposed to nip the intermediate transfer belt and to be movable toward and away from the backup roller T2*a* (for separation and abutting). A region (of nipping) at which the secondary-transfer roller T2*b* abuts against the intermediate transfer belt B forms the secondary-transfer region Q4.

A contact roller T2*c* further abuts against the backup roller T2*a*. The respective rollers T2*a*, T2*b* and T2*c* structure secondary-transfer rollers T2. A secondary-transfer voltage, with the same polarity as a polarity of electric charge of the toner, is applied to the contact roller T2*c* at predetermined times from a power supply circuit E, which is controlled by a controller C.

A supply tray TR1, which accommodates sheets S, and a sheet conveyance path SH are provided downward of the belt module BM. The sheets S accommodated in the supply tray TR1 are taken out by a pickup roller Rp at predetermined times, divided into individual sheets by a cutting roller Rs, and conveyed to a registration roller Rr.

The recording sheet S that has been conveyed to the registration roller Rr is conveyed through a registration side sheet guide SGr and a transfer side sheet guide SG1 to the secondary-transfer region Q4, to match a timing at which the primary-transferred multiple-toner image or single color toner image moves into the secondary-transfer region Q4. While the recording sheet S is passing through the secondary-transfer region Q4, the secondary-transfer potential is applied to the contact roller T2*c* of the secondary-transfer rollers T2. Thus, the color toner images that have been superposedly transferred onto the intermediate transfer belt B are secondary-transferred onto the recording sheet S all together.

After the secondary-transfer, excess toner is removed from the intermediate transfer belt B by a belt cleaner CLB. Further, surface-adhering toner is recovered from the secondary-transfer roller T2*b* by a secondary-transfer roller cleaner CLt.

Herein, the secondary-transfer roller T2*b* and the belt cleaner CLB are provided to be movable toward and away from the intermediate transfer belt B (for separation and abutting). When a color image is being formed, the secondary-transfer roller T2*b* and the belt cleaner CLB are separated from the intermediate transfer belt B until the unfixed toner image of the last color is primary-transferred to the intermediate transfer belt B.

Herein, the secondary-transfer roller cleaner CLt is moved for separation and approach together with the secondary-transfer roller T2*b*.

The recording sheet S to which the toner image has been secondary-transferred is conveyed by a post-transfer sheet guide SG2 and a sheet conveyance belt BH to a fixing region Q5. When the recording sheet S passes through the fixing region Q5, the recording sheet S is fixed with heat and pressure by a fixing device F. The fixing device F includes a pair of fixing rollers Fh and Fp, constituted by a heating roller Fh and a pressure roller Fp. The recording sheet S to which the toner image has been fixed is ejected to a recording sheet ejection tray TR2. Thus, the sheet conveyance path SH is structured by the components identified by the reference characters Rp, Rs, Rr, SG1, SG2 and BH.

Because the respective fixing devices are similarly structured, descriptions will be given below for the black developing device Gk, and detailed descriptions will not be given for the other developing devices Gy, Gm and Gc.

As shown in FIGS. 2 to 4, the developing device Gk is disposed to oppose the photosensitive drum (i.e., image-bearing body) Pk at a developing region Q2 (see FIGS. 3 and 4). The developing device Gk includes a developer container GV, which accommodates a two-component developer formed of a toner and a carrier. The toner is negatively (−) charged, and the carrier is positively (+) charged.

The developer container GV includes a developer container main body 1, a developer container cover 2, which covers an upper end of the developer container 1, and a front side connection member 3, which is joined at a front side of the developer container 1 (see FIG. 2).

The developer container 1 includes a developing roll chamber 4 thereinside. The developing roll chamber 4 accommodates a developing roll R0. The developer container 1 includes a first agitation chamber 6, which is adjacent to the developing roll chamber 4, and a second agitation chamber 7, which is adjacent to the first agitation chamber 6.

The developer container cover 2 includes a roller accommodation wall 2*a*, an upper wall 2*b*, and an engaging wall 2*c*. The roller accommodation wall 2*a* forms the developing roll chamber 4. The upper wall 2*b* is provided over the second agitation chamber 7. The engaging wall 2*c* extends downward from the right side (the +Y side) of the upper wall 2*b* and abuts against a side wall of the developer container main body 1. The roller accommodation wall 2*a* includes a top wall 2*a*1 and a side wall 2*a*2. In the developing roll chamber 4, at an inner face side of the top wall 2*a*1, a layer thickness-regulating member 8 is provided. When the developer container cover 2 is mounted at the developer container main body 1, the layer thickness-regulating member 8 regulates thickness of a layer of developer at the surface of the developing roll R0.

When the developer container cover 2 is mounted at the developer container main body 1, engaging pawls (not shown), which are formed at an outer side face of the developer container main body 1, engage with engaging apertures 2*c*1, which are formed in the engaging wall 2*c*.

The first agitation chamber 6 includes a first main stirring chamber 6*a* at the developer container main body 1 side thereof, and a feedout chamber 6*b* at the side of a left portion (a −Y portion) 3*a* of the front side connection member 3 (see FIG. 5). Meanwhile, the second agitation chamber 7 includes a second main stirring chamber 7*a* at the developer container main body 1 side thereof, and a resupply chamber 7*b* at the side of a right portion (a +Y portion) 3*b* of the front side connection member 3.

Inside the developer container main body 1, a partition wall 9 is formed between the first agitation chamber 6 and the second agitation chamber 7. The partition wall 9 is formed at a region which excludes two end portions of the first main stirring chamber 6*a* and the second main stirring chamber 7*a*. An upper end of the partition wall 9 abuts against a lower end (a −Z side) of the side wall 2*a*2 of the roller accommodation wall 2*a* (see FIGS. 3 and 4), and divides the first agitation chamber 6 from the second agitation chamber 7.

Thus, the first main stirring chamber 6*a* and the second main stirring chamber 7*a* are structured so as to be communicated at both of end portions in the front-rear direction (the X-axis direction): a front side communication portion E1 and a rear side communication portion E2 (see FIG. 5). Thus, a circulatory agitation chamber (6 & 7) is structured by the first agitation chamber 6 and the second agitation chamber 7.

The developing roll R0 is a roller which is provided with a sleeve at an outer side of a magnetic roll which features magnetism (a fixed magnet). Developer in the first main stirring chamber 6*a* is attracted onto a surface of the developing roll R0 by magnetic force of the conductive roller, and is conveyed to the developing region Q2. A roller axle R0*a* of the developing roll R0 is rotatably supported by a front face wall and a rear face wall of the developer container main body 1. A gear G0 is fixed to a rear end (a −X side end) of the roller axle R0*a* (see FIG. 5).

Herein, the developing roll R0 and the photosensitive drum Pk rotate in the same direction. Thus, at a region of opposition, the developer that has been attracted onto the surface of the developing roll R0 is conveyed to the developing region Q2 in a direction opposite to a direction of progress of the photosensitive drum Pk.

Figure 6:
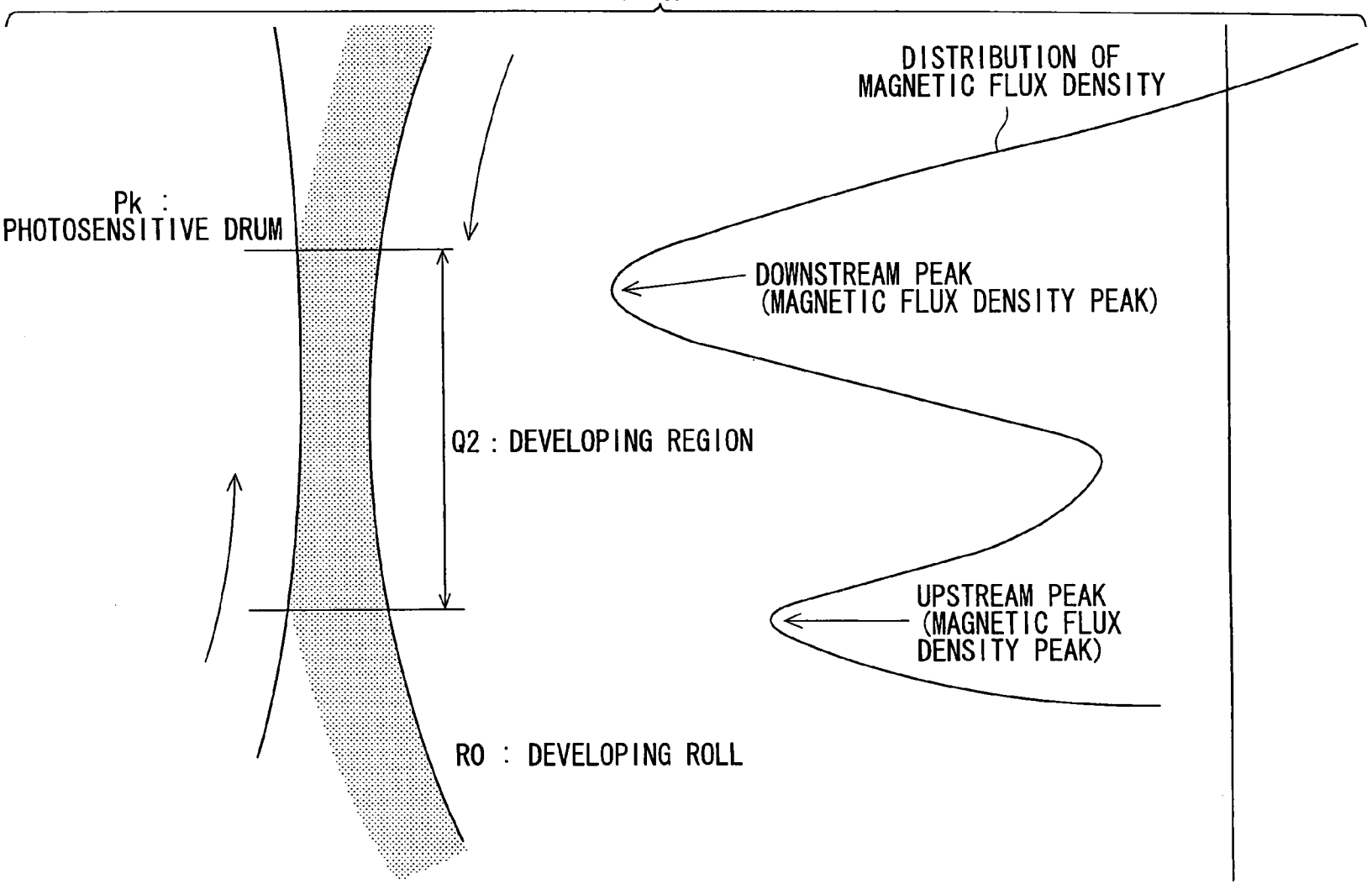
FIG. 6 is a schematic view showing a distribution of magnetic flux density which is provided by a magnetic pole of a developing roll of the developing device relating to the embodiment of the present invention.

The developing roll R0 includes a magnetic pole which features two magnetic flux density peaks, with the same polarization, which oppose the photosensitive drum Pk in the developing region Q2, as shown in FIG. 6. The magnetic flux density peak that is at an upstream side in the direction of rotation of the photosensitive drum Pk is referred to as an upstream pole, and the magnetic flux density peak to the downstream side is referred to as a downstream pole. This downstream pole opposes an end portion of the developing region Q2 at a downstream side in the direction of rotation of the photosensitive drum Pk. A magnetic flux density of the downstream pole has greater magnetic flux density than the upstream pole.

For the present embodiment, a developing roll is described which includes a magnetic pole featuring two magnetic flux density peaks, the upstream pole and the downstream pole. However, this is not a limitation, and the developing roll may include a magnetic pole which features three or even more magnetic flux density peaks.

Figure 7:
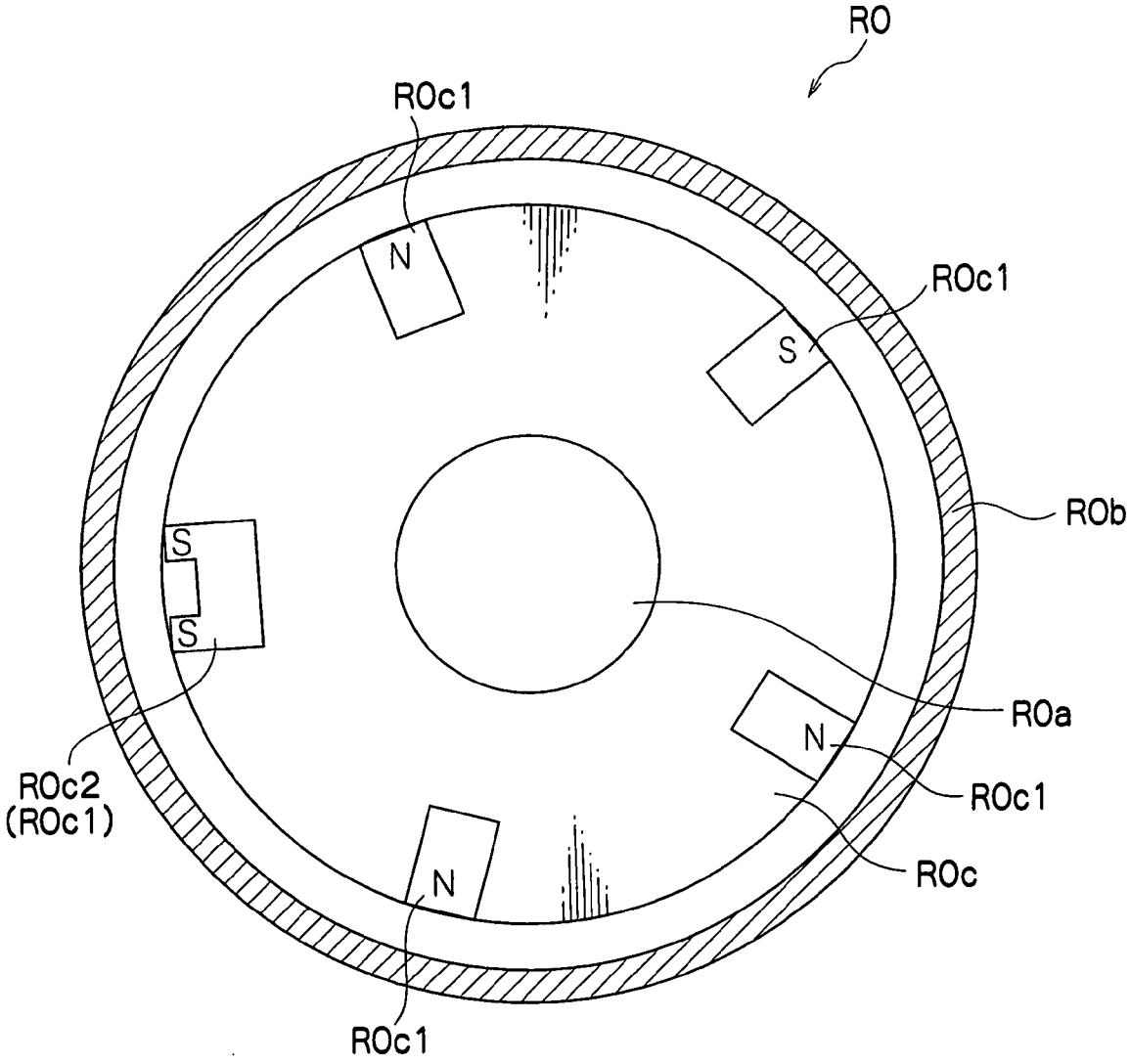
FIG. 7 is a schematic sectional view showing structure of the developing roll of the developing device relating to the embodiment of the present invention.
Figure 7A:
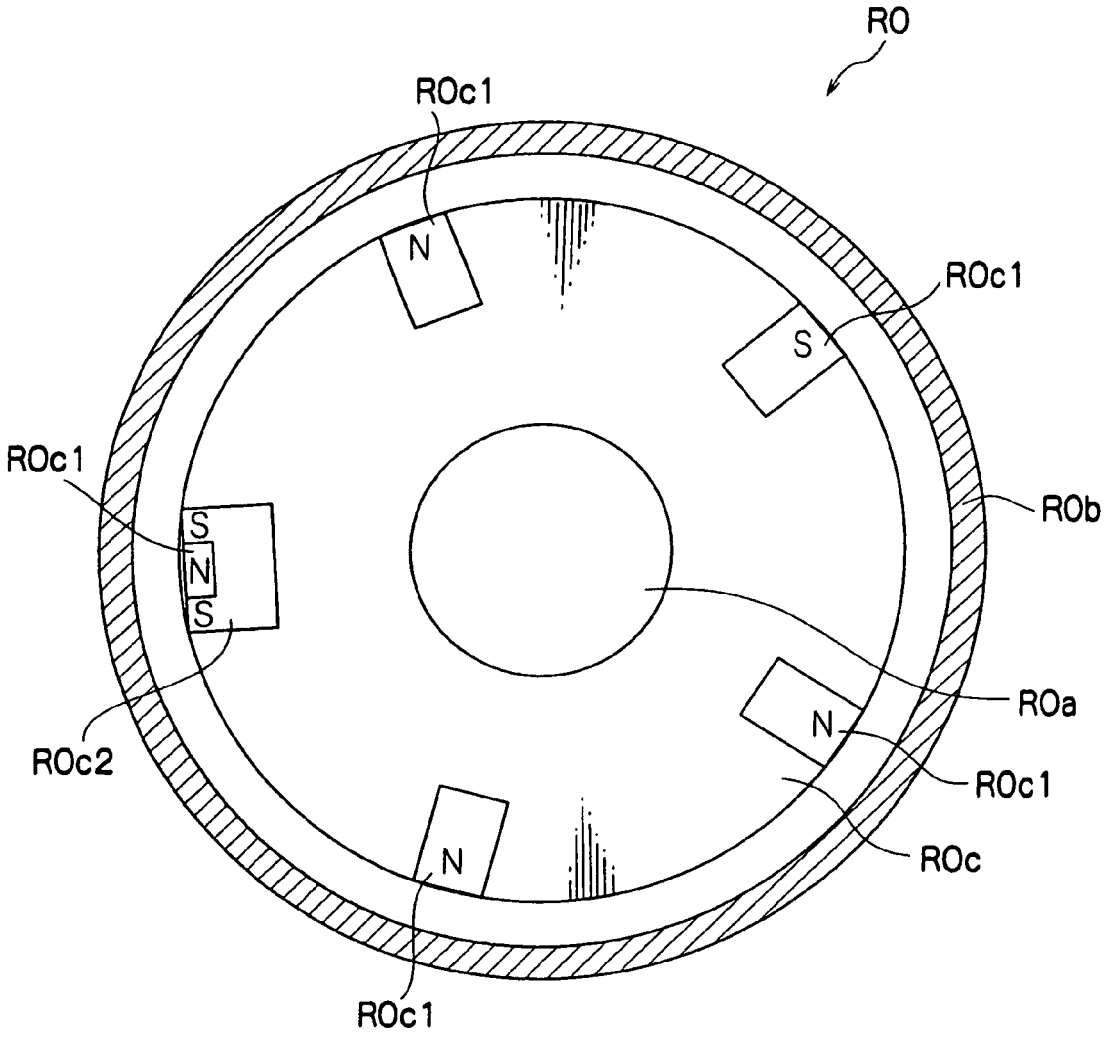
FIG. 7*a* is a schematic sectional view showing structure of the developing roll of the developing device relating to another embodiment of the present invention.

The developing roll R0 featuring this repelling polarization may, for example, be provided with a non-magnetic sleeve R0*b* at an outer side of a magnetic roller R0*c* that features magnetism (the fixed magnet), as is shown in FIG. 7. This magnetic roller R0*c* is produced to have five magnetic poles R0*d* 1embedded therein, with indenting a central portion of one of the magnetic poles R0*c*, which is a developing pole R0*c* 2, so as to form a repelling magnetic pole. Further, an opposite magnetic pole R0*d* 1 may be embedded in the indentation portion of the developing pole R0*c*2, as shown in FIG. 7*a*.

The developing roll R0 featuring this repelling polarization may, for example, be provided with a non-magnetic sleeve R0*b* at an outer side of a magnetic roller R0*c* that features magnetism (the fixed magnet), as is shown in FIG. 7. This magnetic roller R0*c* is produced to have five magnetic poles R0*d*1 embedded therein, with indenting a central portion of one of the magnetic poles R0*c*, which is a developing pole R0*c*2, so as to form a repelling magnetic pole. Further, an opposite magnetic pole R0*d*1 may be embedded in the indentation portion of the developing pole R0*c*2, as shown in FIG. 7*a*.

An unillustrated bias power source is connected to the non-magnetic sleeve R0*b*, so as to apply a predetermined developing bias thereto. (In the present embodiment, a bias in which an alternating component (AC) is superimposed on a direct component (DC) is applied, such that an alternating electric field is applied to the developing region Q2.)

A first stirring member R1 and a second stirring member R2, which agitate and convey the developer, are provided at the first agitation chamber 6 and the second agitation chamber 7. The first stirring member R1 includes a first rotating axle R1*a*, which extends in the axial direction of the developing roll R0, and an agitation and conveyance vane R1*b*, which is fixed to an outer periphery of the first rotating axle R1*a*. The second stirring member R2 similarly includes a second rotating axle R2*a* and an agitation and conveyance vane R2*b*.

The first rotating axle R1*a* is rotatably supported by a front face wall of the left portion 3*a* of the front side connection member 3 and a rear face wall of the developer container main body 1. A gear G1 is fixed to a rear end portion (a −X side end portion) of the first rotating axle R1*a*. The second rotating axle R2*a* is also rotatably supported, by a front face wall (a +X face wall) of the right portion 3*b* of the front side connection member 3 and a rear face wall (a −X face wall) of the developer container main body 1, and a gear G2 is fixed to a rear end portion of the second rotating axle R2*a*. (see FIG. 5).

The agitation and conveyance vane R1*b* of the first stirring member R1 is not provided at the front side communication portion E1 (see FIG. 5). Thus, the agitation and conveyance vane R1*b* is structured such that developer is not conveyed by the first stirring member R1 at the front side communication portion E1. Further, the agitation and conveyance vane R2*b* of the second stirring member R2 (see FIG. 5) is structured so as to apply a force to convey the developer in an opposite direction to the rear side communication portion E2.

The gear G0 of the roller axle R0*a* meshes with the gear G1 of the first rotating axle R1*a*, and the gear G1 meshes with the gear G2 of the second rotating axle R2*a* (see FIG. 5). The gear G0 is structured to transmit rotation force from a developing device motor (which is not shown). When the gear G0 is rotated by this motor, the gear G1 rotates in the opposite direction to the gear G0, and the gear G1 and gear G2 rotate in mutually opposite directions. Thus, the first stirring member R1 and the second stirring member R2, which rotate integrally with the gear G1 and the gear G2, rotate in mutually opposite directions. As a result, developer in the first agitation chamber 6 and developer in the second agitation chamber 7 are conveyed in mutually opposite directions by the rotation of the first stirring member R1 and the second stirring member R2.

Alternatively, the gear G0 of the roller axle R0*a* and the gear G1 of the first rotating axle R1*a* are meshed via an unillustrated idler gear and rotate in the same direction as one another.

Directions of conveyance of the developer by the stirring members can be altered in accordance with the directions of winding of the vanes. Therefore, the directions of conveyance of the developer and directions of rotation of the steering members can be freely selected. Anyhow, the developer in the first agitation chamber 6 and the developer in the second agitation chamber 7 are conveyed in mutually opposite directions.

A developer feedout aperture 3*a*1 (see FIGS. 3, 4 and 5 ) is provided downward of the left portion (−Y portion) 3*a* of the front side connection member 3. A toner resupply aperture 3*b*1 (see FIGS. 3, 4 and 5 ) is provided at an upper right portion of the right portion (Y portion) 3*b* of the front side connection member 3. In order to reduce a proportion of fresh toner supplied through the toner resupply aperture 3*b*1 that is discharged immediately after supply, the toner resupply aperture 3*b*1 is provided at a downstream side in the developer conveyance direction relative to a position of the developer discharge aperture 3*a*1.

In the present embodiment, when an electrophotography process commences and an amount of toner in the developing device Gk falls, toner is continuously resupplied, through a toner resupply channel (not shown) from the toner supply apparatus U2*b*, to the second agitation chamber 7 of the developing device Gk, and is agitated and mixed with developer.

The developer with the supplied toner mixed in moves from the second agitation chamber 7 into the first agitation chamber 6 and is agitated by the first stirring member R1, and the toner is adhered to the surface of the developing roll R0 by magnetic force. Hence, the developer is conveyed to the developing region Q2 by the developing roll R0, from the direction opposite to the direction of rotation of the photosensitive drum Pk, and the electrostatic latent image on the photosensitive drum (image-bearing body) Pk is developed.

Here, the alternating electric field is applied to the developing region Q2 (i.e., the bias in which an alternating component (AC) is superimposed on a direct component (DC) is applied). That is, so-called AC (+DC) development is performed (which is herebelow referred to simply as AC development).

At this time, the developer that has adhered to the developing roll R0 is first exposed to the downstream pole (magnetic flux density peak), which faces the end portion of the developing region Q2 at the downstream side in the direction of rotation of the photosensitive drum Pk, and is then exposed to a repelling region (an intermediate portion between repelling poles). Thus, the development of the electrostatic latent image is implemented.

Whether or not the upstream pole is in contact with the photosensitive drum Pk depends on diameters of the photosensitive drum Pk and the developing roll R0, conveyed amounts of developer, and suchlike. However, what is important is that at least the repelling region (the intermediate portion between the repelling poles) opposes the photosensitive drum Pk. In this structure, it is possible to configure conditions of both roughness and density of the developer during the progress of the developer through the single developing region. Thus, it is possible to achieve effects of both increasing development efficiency and recovering carrier, without causing damage.

In a case in which a repelling pole is utilized at a developing region at which directions of progress of a photosensitive drum Pk and a developing roll R0 are the same (JP-A No. 63-225273 and suchlike), developing efficiency can be raised by a repelling region opposing the photosensitive drum Pk. However, carrier that is correspondingly adhered cannot be recovered at a pole which is downstream relative to the photosensitive drum Pk. This is thought to be because the developer and the photosensitive drum Pk are flowing in the same direction.

Further, it is difficult to produce two matching magnetic poles in order to configure conditions of roughness and density of developer in a developing region. Accordingly, in the present embodiment, a central portion of a single magnetic pole in the developing roll R0 is indented, as shown in FIG. 7, to form repelling magnetic poles. Then, of the upstream pole and the downstream pole that constitute the repelling poles, the downstream pole is caused to oppose the downstream side end portion of the developing region Q2.

As a result, it is possible to raise developing efficiency of the two-component developer without causing occurrences of adherence of carrier to the photosensitive drum Pk.

In particular, because the magnetic flux density of the downstream pole is greater than the magnetic flux density of the upstream pole, when the developer is exposed to the downstream pole and is exposed to the magnetic flux density peak which opposes the end portion of the developing region at the downstream side in the direction of progress of the image-bearing body, an effect of recovery of carrier is increased but an effect of scraping of the toner is not particularly strengthened. As a result, it is possible to more effectively improve developing efficiency of the two-component developer without causing adherences of carrier to the photosensitive drum Pk to occur, than the conventional device.

Furthermore, because the alternating electric field is applied to the developing region Q2, it is possible to more effectively improve developing efficiency of the two-component developer.

Further yet, in the present embodiment, even in a case in which a small-particle diameter toner and small-particle diameter carrier are employed, with which carrier adherence and developing efficiency tend to be lower, it is possible to improve developing efficiency of the two-component developer without causing carrier adherence to the photosensitive drum Pk.

Herein, it is preferable that a volume average particle diameter of a small-particle diameter toner is at least 1.5 μm and at most 5 μm. Further, it is preferable that a volume average particle diameter of a small-particle diameter carrier is not more than 8 times the volume average particle diameter of the toner.

Further, with a view to improving developing efficiency of two-component development without causing carrier adherence to the image-bearing body, it is preferable that a magnetization of the carrier is not more than 50 emu/cm$^3$. A lower limit of the same is 10 emu/cm$^3$, below which conveyance is difficult.

In the present embodiment, a toner to be used can have a well-known structure. The toner can be produced by a well-known method such as, for example, a kneading and pulverization method, a suspension polarization method, an emulsion polarization method or the like. The toner may be produced by an emulsion polymerization and aggregation method, which is capable of providing small-particle diameter toner with a high degree of spherical forming. A carrier (magnetic carrier) to be used can also have a well-known structure.

Herebelow, an example of a process of producion of toner and developer will be illustrated. Therein, respective measurements are performed as follows.

Measurement of volume average particle diameter and particle size distribution: The volume average particle diameter is measured using a COULTER COUNTER TAII (produced by Beckman Coulter), using ISOTON-II (produced by Beckman Coulter) as an electrolyte.

Specifically, as a process of measurement of volume average particle diameter, first, 0.5 to 50 mg of a measurement sample is added to 2 ml of a 5% aqueous solution of a surfactant which acts as a dispersing agent, preferably sodium alkylbenzenesulfonate, and this is added to 100 to 150 ml of the electrolyte. Then, the electrolyte with this measurement sample suspended therein is subjected to dispersion processing for about 1 minute in an ultrasonic dispersing device, and a distribution of particle sizes for particles with particle diameters in a range of 0.6 to 18 μm is measured with the COULTER COUNTER model TA-II, using an aperture with an aperture diameter of 30 μm.

The particle size distribution that has been found is divided into particle size ranges (channels). Specifically, cumulative distributions in terms of volume and number, respectively, are plotted for these channels, accumulating from smaller diameters. Particle diameters at which the cumulative values reach 16% are defined as a volume average particle diameter D16*v* and a number average particle diameter D16*p*. Particle diameters at which the cumulative values reach 50% are defined as a volume average particle diameter D50*v* (which indicates the above-mentioned volume average particle diameter of the toner) and a number average particle diameter D50*p*.

Measurement of magnetization: Magnetization is found by using a vibrating sample magnetometer BHV-525 (produced by Riken Denshi Co., Ltd.), taking a sample of a certain amount with a VSM constant-temperature sample case for powder (H-2902-151), and precisely weighing the sample, after which the magnetization is measured in a magnetic field of 398 kA/m (5 kOe).

Measurement of particle diameter: In a case of measuring particle diameters of less than 1 μm, a laser scattering particle size distribution analyzer (LA-700, produced by Horiba, Ltd.) is used for the measurement. As a measurement process, a sample in the form of a dispersion fluid is prepared so as to correspond to a solid component of about 2 g. This is added to ion-exchanged water to make up a volume of about 40 ml. This is charged into a cell up to a suitable density, the cell is left standing for about 2 minutes, and a density of the cell in a substantially stable state is measured. Volume average particle diameters that are obtained for each of channels are accumulated, from smaller volumes, and a diameter at which the cumulative value reaches 50% is the volume average particle diameter.

Measurement of molecular weight and molecular weight distribution:

For gel permeation chromatography, HLC-8120GPC and SC-8020 devices (produced by Tosoh Corporation) are used, two columns of TSKgel and SuperHM-H (produced by Tosoh Corporation) are used for columns, and THF (tetrahydrofuran) is used as an eluent. Testing is carried out using an IR detector, with testing conditions being a sample density of 0.5%, a flow rate of 0.6 ml/min, a sample infusion amount of 10 μl and a measurement temperature of 40° C.

A calibration curve is prepared from ten samples of "polystyrene standard samples, TSK standard", produced by Tosoh Corporation: A-500, F-1, F-10, F-80, F-380, A-2500, F-4, F-40, F-128 and F-700.

Measurement of melting point and glass transition temperature:

Melting points (melting points of releasing agents) and glass transition temperatures (glass transition temperatures of toner) are found from principal maximum peaks measured in accordance with ASTM D3418-8. For measurement of a principal maximum peak, it is possible to use a DSC-7, produced by PerkinElmer, Inc. Melting points of indium and zinc are used for temperature correction of a detection section of this device, and the heat of fusion of indium is used for correction of heat amounts. For the sample, a pan made of aluminium is used, a pan containing nothing is set as a control, and measurement is performed with a rate of temperature increase of 10° C./min.

—Process of Producion of Toner and Developer—

| Preparation of Resin Particle Dispersion (1) | |
|---|---|
| Styrene | 480 parts by weight |
| n-butyl acrylate | 120 parts by weight |
| Carboxyethyl acrylic acid | 18 parts by weight |
| Dodecane thiol | 12 parts by weight |

The components described above are mixed and dissolved to prepare a solution. Meanwhile, 12 parts by weight of an anionic surfactant (DOWFAX, produced by The Dow Chemical Company) is dissolved in 250 parts by weight of ion-exchanged water. This is added to the above-mentioned solution to prepare a solution which is dispersed and emulsified in a flask (monomer emulsion A).

Further, 1 part by weight of the same anionic surfactant (DOWFAX, produced by The Dow Chemical Company) is dissolved in 555 parts by weight of ion-exchanged water, and charged into a polymerization flask.

The polymerization flask is sealed, flux piping is installed and, while nitrogen is being introduced, the flask is stirred slowly, heated in a water bath to 75° C., and retained. 9 parts by weight of ammonium persulfate is dissolved in 43 parts by weight of ion-exchanged water, which is passed through a metering pump in the polymerization flask and is dripped in over 20 minutes, after which the monomer emulsion A is dripped in through the metering pump over 200 minutes. Thereafter, while the slow stirring continues, the polymerization flask is kept at 75° C. for 3 hours, and polymerization is completed.

Thus, a resin particle dispersion (1), with a core diameter of the particles of 250 nm, a glass transition temperature of 55° C., a weight average molecular weight of 27000 and a solids content of 42%, is obtained.

| Preparation of Colorant Particle Dispersion (1) | |
|---|---|
| Carbon black (MOGUL L, produced by Cabot Corporation) | 50 parts by mass |
| Non-ionic surfactant (NONIPOL 400, produced by Sanyo Chemical Industries, Ltd.) | 5 parts by mass |
| Ion-exchanged water | 200 parts by mass |

The components described above are mixed and dissolved, and dispersed over 10 minutes with a homogenizer (ULTRA TURRAX T50, produced by IKA Group). Thus, a colorant particle dispersion (1) is prepared, in which a colorant (the carbon black) having an average particle diameter of 250 nm is dispersed.

| Preparation of Releasing agent Particle Dispersion | |
|---|---|
| HNP09 (produced by Nippon Seiro Co., Ltd., melting point 75° C.) | 50 parts by weight |
| Anionic surfactant (DOWFAX, produced by The Dow Chemical Company) | 5 parts by weight |
| Ion-exchanged water | 200 parts by weight |

The components described above are heated to 110° C., thoroughly dispersed with a homogenizer (ULTRA TURRAX T50, produced by IKA Group), and then dispersionprocessed with a pressure discharge-type homogenizer (a GAULIN homogenizer, produced by Gaulin Corporation). Thus, a releasing agent particle dispersion with a core diameter of 120 nm and a solids content of 21.0% is obtained.

| Preparation of Toner and Developer 1 | |
|---|---|
| Resin particle dispersion (1) | 130.8 parts by weight<br>(54.94 parts by weight of resin) |
| Colorant particle dispersion (1) | 39.5 parts by weight<br>(8.5 parts by weight of pigment) |
| Releasing agent particle dispersion | 38.1 parts by weight<br>(8 parts by weight of releasing agent) |
| Polyaluminium chloride | 0.14 parts by weight |

The components listed above are thoroughly mixed and dispersed, in a round bottomed flask made of stainless steel, by a homogenizer (ULTRA TURRAX T50, produced by IKA Group). Thereafter, the flask is heated to 40° C. in an oil bath for heating, while being stirred, and is held at 40° C. for 60 minutes. 68 parts by weight of the resin particle dispersion (1) (28.56 parts by weight of resin) is added, and this is stirred slowly. Then, the temperature is raised to 51° C., and this temperature is maintained for 180 minutes. It is confirmed with a COULTER COUNTER that the particle distribution is getting narrower.

Thereafter, a system interior pH is adjusted to 6.5 with 0.5 mol/liter aqueous solution of sodium hydroxide, and the system is heated to 95° C. while stirring is continued.

After reaction has finished, this solution is cooled, filtered, thoroughly washed with ion-exchanged water, and subjected to solid-liquid separation with a Nutsche-type suction filter. Then, the solids are re-dispersed in 3 liters of ion-exchanged water at 40° C., stirred at 300 rpm for 15 minutes, and washed. This washing operation is repeated five times, solid-liquid separation is performed with a Nutsche-type suction filter, and freeze-drying is performed for 10 hours with settings such that a final drying temperature is 40° C. Thus, toner particles 1 are provided.

When diameters of these toner particles 1 are measured with a COULTER COUNTER, a volume average particle diameter D50 is 3.2 μm, and a particle size distribution index for small diameters GSDps is 1.23. Further, a shape factor SF1 of the toner particles, which is found by observing shapes with a LUZEX, is a state of sphericality of 120.

2 parts by weight of hydrophobic silica (TS720, produced by Cabot Corporation) is added to 50 parts by weight of the above-described toner, and this is mixed in a sample mill to provide an external additive toner 1.

Then, a ferrite carrier (magnetized to 40 emu/cm$^3$) with a volume average particle diameter of 30 μm, which is coated to 1% with polymethyl methacrylate (produced by Soken Chemical & Engineering Co., Ltd.), is deployed. The above-described external additive toner is weighed out such that toner density will be 6% by weight, and the toner and the carrier are stirred and mixed for 5 minutes in a ball mill to prepare a developer 1.

Preparation of Toner and Developer 2

Toner particles 2 are produced by the same process as the toner particles 1, except that the temperature specified for the preparation of the toner particles 1 is altered to 25° C. The volume average particle diameter D50 is 1.5 μm, the small diameter particle size distribution index GSDps is 1.24, and the shape factor SF1 is a state of sphericality of 118.

The toner particles 2 provide an external additive toner 2 by the same process as for external additive toner 1, and a developer 2 is prepared from the external additive toner 2 by a process the same as for the developer 1.

Preparation of Toner and Developer 3

Toner particles 3 are produced by the same process as the toner particles 1, except that the temperature specified for the preparation of the toner particles 1 is altered to 45° C. The volume average particle diameter D50 is 5.1 μm, the small diameter particle size distribution index GSDps is 1.22, and the shape factor SF1 is a state of sphericality of 122.

The toner particles 3 provide an external additive toner 3 by the same process as for external additive toner 1, and a developer 3 is prepared from the external additive toner 3 by a process the same as for the developer 1.

Preparation of Toner and Developer 4

Toner particles 4 are produced by the same process as the toner particles 1, except that the temperature specified for the preparation of the toner particles 1 is altered to 50° C. The volume average particle diameter D50 is 5.8 μm, the small diameter particle size distribution index GSDps is 1.22, and the shape factor SF1 is a state of sphericality of 121.

The toner particles 4 provide an external additive toner 4 by the same process as for external additive toner 1, and a developer 4 is prepared from the external additive toner 4 by a process the same as for the developer 1.

Preparation of Toner and Developer 5

Toner particles 5 are produced by the same process as the toner particles 1, except that the temperature specified for the preparation of the toner particles 1 is altered to 54° C. The volume average particle diameter D50 is 6.5 μm, the small diameter particle size distribution index GSDps is 1.21, and the shape factor SF1 is a state of sphericality of 122.

The toner particles 5 provide an external additive toner 5 by the same process as for external additive toner 1, and a developer 5 is prepared from the external additive toner 5 by a process the same as for the developer 1.

Preparation of Toner and Developer 6

Toner particles 6 are produced by the same process as the toner particles 1, except that the temperature specified for the preparation of the toner particles 1 is altered to 56° C. The volume average particle diameter D50 is 7.5 μm, the small diameter particle size distribution index GSDps is 1.21, and the shape factor SF1 is a state of sphericality of 123.

The toner particles 6 provide an external additive toner 6 by the same process as for external additive toner 1, and a developer 6 is prepared from the external additive toner 6 by a process the same as for the developer 1.

EXAMPLES

Example 1

The image formation device relating to the present embodiment is employed. Toners are prepared in accordance with the producion process described above, with respective volume average particle diameters of 1.5 μm, 3.2 μm, 5.1 μm, 5.8 μm, 6.5 μm and 7.5 μm. A developer with such a toner and the carrier (toner density at 6% by weight) is thoroughly stirred, and is then charged into the developing device (i.e., the agitation chamber). Supply of the toner at a 1% by weight proportion is commenced and, in an environment of the room temperature and humidity (23° C., 50%

RH), printing is executed in accordance with the electrophotography process under conditions according to table 1. Toner density latitude and adherence of carrier to the photosensitive drum are evaluated.

For comparison, printing is executed, in accordance with the electrophotography process under conditions according to table 1, and evaluated in the same manner, except that a developing roll that is employed has a magnetic pole (one main development pole) with only one magnetic flux density peak (100 mT) in the developing region.

The results are shown in table 1. Experimental conditions and evaluation methods are shown below.

—Experimental Conditions—

Photosensitive drum charging potential=−650 V

Image portion potential=−200 V

DC development: DC bias=−500 V

AC (+DC) development: DC bias component=−500 V, AC bias Vpp=1.5 kV, AC bias frequency=9 kHz Developing roll: diameter=18 mm, surface roughness Rz=24 μm Photosensitive drum-developing roll spacing=0.4 mm Developing roll/photosensitive drum speed ratio:

conventional=2.0 (with the developing roll and the photosensitive drum rotating in the same direction), present embodiment=1.0 (with the developing roll and the photosensitive drum rotating in opposite directions)

—Evaluation Methods—

Toner density latitude: A case of an image where developing density and background fogging meet predetermined standards in at least 5% of the toner density range is shown as "A", a case of at least 3% is shown as "B", and a case of less than 3% is shown as "C".

For the standard of developing density, the standard is judged to be met when a measurement of a density on paper, with an X-LITE, after fixing of a region with 100% coverage is at least a certain value (1.4).

For the standard of background fogging, the standard is judged to be met when background fogging is no worse than the average level at which a border is distinguished from a white background portion in a sensory evaluation by a large number of persons, in visual inspection using a criterion sample.

Carrier adherence to photosensitive drum: This is judged from transfer to a tape on the photosensitive drum, by reference to a number of carrier particles in a certain area. A case of 0/100 $cm^2$ is shown as "A", a case of 1/100 $cm^2$ is shown as "B", and a case of 2 or more/100 $cm^2$ is shown as "C".

TABLE 1

Evaluation results of toner density latitude/carrier adherence to photosensitive drum

| | | | 1.5-μm toner | 3.2-μm toner | 5.1-μm toner | 5.8-μm toner | 6.5-μm toner | 7.5-μm toner |
|---|---|---|---|---|---|---|---|---|
| Comparative Example | AC development | One main development pole: 100 mT | C/A | C/A | A/A | A/A | A/A | A/A |
| | DC development | One main development pole: 100 mT | C/A | C/A | C/A | C/A | A/A | A/A |
| Present Embodiment | DC development | Upstream pole: 70 mT Downstream pole: 70 mT | B/A | B/A | B/A | B/A | A/A | A/A |
| | DC development | Upstream pole: 80 mT Downstream pole: 70 mT | B/A | B/A | B/A | B/A | A/A | A/A |
| | DC development | Upstream pole: 70 mT Downstream pole: 80 mT | B/A | B/A | B/A | B/A | A/A | A/A |
| | AC development | Upstream pole: 70 mT Downstream pole: 70 mT | B/A | B/A | A/A | A/A | A/A | A/A |
| | AC development | Upstream pole: 80 mT Downstream pole: 70 mT | B/A | B/A | A/A | A/A | A/A | A/A |
| | AC development | Upstream pole: 70 mT Downstream pole: 80 mT | B/A | B/A | A/A | A/A | A/A | A/A |

Example 2

Printing is executed, in accordance with the electrophotography process under conditions according to table 2, and evaluated in the same manner as in Example 1, except that the volume average particle diameter of the carrier is varied (10 μm and 20 μm). Here, AC development is applied.

The results are shown in table 2.

TABLE 2

Evaluation results of toner density latitude/carrier adherence to photosensitive drum

| | | | 1.5-μm toner | 3.2-μm toner | 5.1-μm toner | 5.8-μm toner | 6.5-μm toner | 7.5-μm toner |
|---|---|---|---|---|---|---|---|---|
| Comparative Example | Carrier with particle diam. 20 μm | One main development pole: 100 mT | C/C | C/C | C/C | C/C | C/C | C/C |
| | Carrier with particle diam. 10 μm | One main development pole: 100 mT | C/C | C/C | C/C | C/C | C/C | C/C |

TABLE 2-continued

| | | | 1.5-μm toner | 3.2-μm toner | 5.1-μm toner | 5.8-μm toner | 6.5-μm toner | 7.5-μm toner |
|---|---|---|---|---|---|---|---|---|
| | Evaluation results of toner density latitude/carrier adherence to photosensitive drum | | | | | | | |
| Present Embodiment | Carrier with particle diam. 20 μm | Upstream pole: 70 mT Downstream pole: 70 mT | B/B | A/B | A/B | A/B | A/B | A/B |
| | Carrier with particle diam. 20 μm | Upstream pole: 80 mT Downstream pole: 70 mT | B/B | A/B | A/B | A/B | A/B | A/B |
| | Carrier with particle diam. 20 μm | Upstream pole: 70 mT Downstream pole: 80 mT | B/A | A/A | A/A | A/A | A/A | A/A |
| | Carrier with particle diam. 10 μm | Upstream pole: 70 mT Downstream pole: 70 mT | A/B | A/B | A/B | A/B | A/B | A/B |
| | Carrier with particle diam. 10 μm | Upstream pole: 80 mT Downstream pole: 70 mT | A/B | A/B | A/B | A/B | A/B | A/B |
| | Carrier with particle diam. 0 μm | Upstream pole: 70 mT Downstream pole: 80 mT | A/A | A/A | A/A | A/A | A/A | A/A |

Example 3

Printing is executed, in accordance with the electrophotography process under conditions according to table 3, and evaluated in the same manner as in Example 1, except that the volume average particle diameter of the carrier is varied (10 μm and 20 μm) and magnetization of the carrier is varied (42 emu/cm$^3$, 52 emu/cm$^3$ and 62 emu/cm$^3$). Here, only examples of the present embodiment are implemented, and AC development with the upstream pole at 70 mT and the downstream pole at 80 mT is applied. The results are shown in table 3.

TABLE 3

| Present Embodiment | | 1.5-μm toner | 3.2-μm toner | 5.1-μm toner | 5.8-μm toner | 6.5-μm toner | 7.5-μm toner |
|---|---|---|---|---|---|---|---|
| Evaluation results of toner density latitude/carrier adherence to photosensitive drum | | | | | | | |
| Carrier with particle diam 20 μm, magnetization 42 emu/cm$^3$ | Upstream pole: 70 mT Downstream pole: 80 mT | A/A | A/A | A/A | A/A | A/A | A/A |
| Carrier with particle diam 20 μm, magnetization 52 emu/cm$^3$ | Upstream pole: 70 mT Downstream pole: 80 mT | A/A | A/A | A/A | A/A | A/A | A/A |
| Carrier with particle diam 20 μm, magnetization 62 emu/cm$^3$ | Upstream pole: 70 mT Downstream pole: 80 mT | B/A | A/A | A/A | A/A | A/A | A/A |
| Carrier with particle diam 10 μm, magnetization 42 emu/cm$^3$ | Upstream pole: 70 mT Downstream pole: 80 mT | A/A | A/A | A/A | A/A | A/A | A/A |
| Carrier with particle diam 10 μm, magnetization 52 emu/cm$^3$ | Upstream pole: 70 mT Downstream pole: 80 mT | B/A | A/A | A/A | A/A | A/A | A/A |
| Carrier with particle diam 10 μm, magnetization 62 emu/cm$^3$ | Upstream pole: 70 mT Downstream pole: 80 mT | B/A | A/A | A/A | A/A | A/A | A/A |

From table 1, it can be seen that the present embodiment is effective in regard to fogging when toner density is raised above 1% by weight in the resupply of toner. In particular, it can be seen that AC development (with application of an AC bias, which is to say application of an alternating electric field to the developing region) is more advantageous than DC development (with application of a DC bias) in regard to toner density latitude. Thus, it can be seen that excellent images which are free of fogging will be obtained even when there are variations in environment such that the toner density is raised above 1% by weight.

Further, it can be seen from tables 1 and 2 that, with small-particle diameter toners, smaller carrier diameters are more advantageous for toner density latitude.

Further yet, it can be seen from table 2 that, when a small-particle diameter carrier is used in order to achieve toner density latitude with a small-particle diameter toner, toner density latitude and carrier adherence deteriorate in the Comparative Example, whereas satisfactory toner density latitude is provided with the present embodiment. In particular, carrier adherence to the photosensitive drum is effectively prevented by increasing the magnetic flux density of the downstream pole of the repelling poles for development.

Further still, it can be seen from table 3 that, in a case of large magnetic flux density at the downstream pole of the repelling poles for development, deterioration in toner density latitude and carrier adherence to the photosensitive drum are effectively avoided with a carrier magnetization of about 50 emu/g or less.

Here, with regard to carrier magnetization, an additional experiment is performed with the 1.5-μm toner. With a carrier magnetization of 15 emu/cm$^3$, carrier adherence deteriorates slightly, but with a carrier magnetization of 26 emu/cm$^3$, the standards are met. Therefore, it can be seen that a lower limit value of magnetization of the carrier may be a value larger than 15 emu/cm$^3$.

From these results it can be seen that, with the present embodiment, the developing efficiency of two-component development can be raised without causing occurrences of adherence of carrier to the photosensitive drum (image-bearing body). In particular, it can be seen that this effect is remarkable when a small-particle diameter carrier is employed in order to make use of a small-particle diameter toner.

Note that the present Examples do not limit the type of magnetic flux densities of the repelling poles. As long as the repelling poles are present, toner density latitude and carrier adherence to a photosensitive drum can be effectively prevented. In particular, provided an upstream pole is not excessively stronger in magnetic flux density than the downstream pole, spikes are thoroughly loosened in a region of development onto the photosensitive drum (a development nipping region), and sufficient developing density is obtained even with a small-particle diameter carrier. Therefore, toner density latitude will be provided. Furthermore, provided the downstream pole is stronger in magnetic flux density than the upstream pole(s), a characteristic of suppressing carrier adherence is improved. Because development density retrieval, carrier adherence and the like also vary in accordance with a contrast between potentials in development, it will be necessary to optimize a specific profile of magnetic flux densities, development poles and the like to suit each development system.

What is claimed is:

1. A developing device for developing an electrostatic latent image, which is formed on an image-bearing body, with a developer which includes a toner and a carrier, the developing device comprising:

a developing roll, which includes a fixed magnet at an interior portion and a rotatable sleeve at an outer side thereof, and which is disposed to oppose the image-bearing body, and which rotates while carrying the developer, and conveys the developer to a developing region in a direction opposite to a direction of progress of the image-bearing body for developing the electrostatic latent image formed on the image-bearing body, wherein the developing roll includes a magnetic pole which includes, in a circumferential direction of the developing roll, at least two magnetic flux density peaks with the same polarity in the developing region, one of the magnetic flux density peaks opposing an end portion of the developing region at a downstream side in the direction of progress of the image-bearing body, and of the at least two magnetic flux density peaks included at the magnetic pole, the magnetic flux density peak that is disposed at an end portion of the developing region on the downstream side of progress direction of the image-bearing body includes a magnetic flux density greater than a magnetic flux density peak that is disposed further to the upstream side.

2. The developing device of claim 1, wherein an alternating electric field is applied to the developing region.

3. The developing device of claim 1, wherein the carrier comprises a magnetization of at most 50 emu/cm$^3$.

4. The developing device of claim 1, wherein the toner comprises a volume average particle diameter of at least 1.5 μm and at most 5 μm.

5. The developing device of claim 1, wherein the carrier comprises a volume average particle diameter of at most 8 times a volume average particle diameter of the toner.

6. An image formation device comprising:

a developing section which develops an electrostatic latent image, which is formed on an image-bearing body, with toner; and a transfer section which transfers a toner image that has been developed on the image-bearing body to a recording medium for forming an image, wherein the developing section includes the developing device of claim 1.

7. A developing device for developing an electrostatic latent image, which is formed on an image-bearing body, with a developer which includes a toner and a carrier, the developing device comprising:

a developing roll which includes a fixed magnet and a non-magnetic sleeve rotatably provided at an outer side of the fixed magnet, and which is disposed so as to oppose the image-bearing body at a developing region; and a magnetic pole embedded in the fixed magnet, the magnetic pole being structured so as to include, in a circumferential direction of the developing roll, at least two magnetic flux density peaks with the same polarity in the developing region, wherein the developing roll rotates while carrying the developer, and conveys the developer to the developing region in a direction opposite to a direction of progress of the image-bearing body for developing the electrostatic latent image formed on the image-bearing body, the magnetic pole is structured such that one of the magnetic flux density peaks is disposed at an end portion of the developing region at a downstream side in the direction of progress of the image-bearing body, and a magnetic flux density of the one magnetic flux density peak that is disposed at an end portion of the developing region on the downstream side of progress direction of the image-bearing body is greater than a magnetic flux density of another magnetic flux density peak, which is disposed further to the upstream side.

8. The developing device of claim 7, wherein the magnetic pole comprises an indentation portion formed such that the magnetic pole includes, in the circumferential direction, the at least two magnetic flux density peaks with the same polarity in the developing region.

9. The developing device of claim 8, wherein another magnetic pole, with an opposite polarity to the magnetic pole, is embedded at the indentation portion.

10. The developing device of claim 8, wherein a repelling magnetic pole is formed at the indentation portion.

11. The developing device of claim 7, wherein an alternating electric field is applied to the developing region.

12. The developing device of claim 7, wherein the carrier comprises a magnetization in a range of 10 to 50 emu/cm$^3$.

13. The developing device of claim 7, wherein the toner comprises a volume average particle diameter in a range of 1.5 to 5 μm.

14. The developing device of claim 7, wherein the carrier comprises a volume average particle diameter of at most 8 times a volume average particle diameter of the toner.

15. An image formation device comprising:

the developing device of claim 7; and a transfer section which transfers a toner image, which has been developed on the image-bearing body by the developing device, to a recording medium for forming an image.

* * * * *